US009744537B2

(12) United States Patent
Convery et al.

(10) Patent No.: US 9,744,537 B2
(45) Date of Patent: Aug. 29, 2017

(54) PROCESS AND APPARATUS FOR REFINING SAND

(71) Applicant: CDE Global Limited, Cookstown, County Tyrone (GB)

(72) Inventors: Anthony Convery, Maghera (GB); Glenn Sloan, Castlerock (GB)

(73) Assignee: CDE Global Limited, Cookstown, County Tyrone (GB)

( * ) Notice: Subject to any disclaimer, the term of this patent is extended or adjusted under 35 U.S.C. 154(b) by 0 days.

(21) Appl. No.: 14/877,306

(22) Filed: Oct. 7, 2015

(65) Prior Publication Data

US 2016/0101428 A1 Apr. 14, 2016

(30) Foreign Application Priority Data

Oct. 8, 2014 (GB) ..... 1417830.5

(51) Int. Cl.

| | |
|---|---|
| ***B03B 7/00*** | (2006.01) |
| ***B03B 9/02*** | (2006.01) |
| ***B03B 9/00*** | (2006.01) |
| ***B03B 5/34*** | (2006.01) |
| ***B03B 5/48*** | (2006.01) |

(52) U.S. Cl.

CPC ..... *B03B 9/02* (2013.01); *B03B 5/34* (2013.01); *B03B 5/48* (2013.01); *B03B 7/00* (2013.01); *B03B 9/00* (2013.01)

(58) Field of Classification Search

CPC .. B03B 5/34; B03B 5/48; B03B 5/623; B03B 7/00; B03B 9/02; B07B 2230/01

See application file for complete search history.

(56) References Cited

U.S. PATENT DOCUMENTS 1,410,340 A * 3/1922 Merwin ..... B03B 5/60 209/156
5,049,261 A * 9/1991 Tapp ..... B03B 9/00 209/11

(Continued)

FOREIGN PATENT DOCUMENTS

| | | |
|---|---|---|
| WO | 2010/088090 | 8/2010 |
| WO | 2011/077183 | 6/2011 |
| WO | 2014/106302 | 4/2014 |

OTHER PUBLICATIONS

McLanahan Corp., "McLanahan, CEMCO Build First Portable Frac Sand Plant", published in Rock Products Magazine Jun. 11, 2012 , downloaded from <http://www.cemcoturbo.com/news_frac.html>.*

(Continued)

*Primary Examiner* — Joseph C Rodriguez
(74) *Attorney, Agent, or Firm* — Gardner, Linn, Burkhart & Flory, LLP

(57) ABSTRACT

A process for refining sand for use as frac sand includes the steps of passing the sand through a first fines separation stage to remove fine particles of contaminant from the sand, reducing the water content of the sand (such as to less than 20%), passing the sand into an attrition scrubber unit containing moving blades to delaminate clay and other contaminants from the sand grains, passing the sand from the attrition scrubber unit through a second fines separation stage to separate fine contaminants from the sand, and dewatering the resulting sand product in a further dewatering stage.

16 Claims, 5 Drawing Sheets

(56) References Cited

U.S. PATENT DOCUMENTS

| | | | | |
|---|---|---|---|---|
| 7,461,746 | B1 * | 12/2008 | Egge | B02C 21/02 209/268 |
| 8,317,904 | B2 * | 11/2012 | Sarshar | B01D 19/0057 95/259 |
| 8,636,149 | B2 * | 1/2014 | Craig | B03B 5/52 209/159 |
| 9,409,184 | B1 * | 8/2016 | Mickelson | B07B 1/005 |
| 2004/0026342 | A1 | 2/2004 | O'Brien et al. | |
| 2004/0112822 | A1 * | 6/2004 | Saik | B01D 21/10 210/241 |
| 2010/0071902 | A1 | 3/2010 | Ziegler | |
| 2015/0135636 | A1 * | 5/2015 | Ayres | B07B 15/00 52/745.03 |
| 2016/0263583 | A1 * | 9/2016 | Moran | B07B 1/00 |

OTHER PUBLICATIONS

European Search Report corresponding to European Application No. 15188405, dated Feb. 11, 2016.

UK Search Report corresponding to UK Application No. GB1516964.2, dated Feb. 23, 2016.

* cited by examiner

PROCESS AND APPARATUS FOR REFINING SAND

FIELD OF THE INVENTION

This invention relates to a process and apparatus for refining sand and, in particular, to a process and apparatus for refining frac sand.

BACKGROUND OF THE INVENTION

"Frac sand" is a high-purity silica sand with very durable and very round grains. It is a crush-resistant material produced for use by the petroleum industry. It is used in the hydraulic fracturing process (known as "fracking") to produce petroleum fluids, such as oil, natural gas and natural gas liquids from rock units that lack adequate pore space for these fluids to flow to a well.

Some subsurface rock formations, such as organic shale, contain large amounts of oil, natural gas or natural gas liquids that will not flow freely to a well. They will not flow to a well because the rock unit either lacks permeability (interconnected pore spaces) or the pore spaces in the rock are so small that these fluids can not flow through them.

The hydraulic fracturing process solves this problem by generating fractures in the rock. This is done by drilling a well into the rock, sealing the portion of the well in the petroleum-bearing zone, and pumping water under high pressure into that portion of the well. This water is generally treated with a chemicals and thickeners such as guar gum to create a viscous gel. This gel facilitates the water's ability to carry grains of frac sand in suspension.

Large pumps at the surface increase the water pressure in the sealed portion of the well until it is high enough to exceed the breaking point of the surrounding rocks. When their breaking point is reached, the rocks fracture suddenly and water rushes rapidly into the fractures, inflating them and extending them deeper into the rock. Billions of sand grains are carried deep into the fractures by this sudden rush of water. A few thousand tons of frac sand may be required to stimulate a single well.

When the pumps are turned off, the fractures deflate but cannot close completely because they are propped open by the frac sand. This only occurs if enough sand grains to resist the force of the closing fractures have been delivered into the rock.

The new fractures in the rock, propped open by the durable sand grains, form a network of pore space that allows petroleum fluids to flow out of the rock and into the well. Frac sand is known as a "proppant" because it props the fractures open.

Frac sand must meet very demanding specifications. Frac sand must usually comprise high-purity silica sand with a specific grain size perfectly matched to job requirements, with a spherical shape that enables it to be carried in hydraulic fracturing fluid with minimal turbulence, along with a durability to resist crushing forces of closing fractures. Frac sand is produced in a range of sizes from as small as 0.1 mm in diameter to over 2 mm in diameter depending upon customer specifications. Most of the frac sand used is between 0.4 and 0.8 mm in size.

Frac sand specifications are the responsibility in the USA of the American Petroleum Institute (API) and the current standard is API RP 56. These specifications are very demanding and, as a result, suitable deposits are limited. The limited availability of natural reserves which are suitable for frac sand production coupled with growing demand ensures a high price for any producers able to meet the API RP 56 frac sand specifications.

Frac sand is not used straight from the ground. It requires processing or refining to optimize its performance. After mining, the sand is cleaned in a washing plant to remove clay, silt and other fine contaminants. After washing, the sand is typically stacked in piles to allow the wash water to drain off. This operation is usually done outdoors and is restricted to times of the year when temperatures are above freezing. After the sand is drained, it is typically placed in an air dryer to remove all moisture. The dry grains are then screened to obtain specific size fractions for different customers. Sand that is not suitable for fracking may be separated and sold for other uses.

Some sand refining plants are located at the mine site. However, known sand refining plants are very expensive and time consuming to build and are usually very large. Therefore they are often shared by multiple mines. These plants are therefore often centrally located to several mines and the sand is delivered to the plant by truck, train or conveyer.

SUMMARY OF THE INVENTION

The present invention is to provide a cost effective portable frac sand refining process and apparatus that can be readily installed at a mine/quarry site, and which in some embodiments can be containerised for transportation to site.

According to a first aspect of the present invention there is provided a process for refining sand for use as frac sand, the process including the steps of passing the sand through a first fines separation stage to remove fine particles of contaminant from the sand, reducing the water content of the sand (for example, to less than 20%), passing the sand into an attrition scrubber unit containing moving blades to delaminate clay and other contaminants from the sand grains, passing the sand from the attrition scrubber unit through a second fines separation stage to separate fine contaminants from the sand, and dewatering the resulting sand product in a further dewatering stage.

The first and/or second fines separating stages may be carried out in a respective hydro-cyclone unit. The or each hydro-cyclone unit may have multiple cyclones arranged in parallel to one another.

Optionally, the water content of the sand downstream of the first fines separation stage is reduced by means of a first dewatering screen. The further dewatering stage may be carried out on a second dewatering screen.

The process may include a first step of grading the sand to remove oversize material from the sand on a vibratory screen having an apertured deck upstream of the first fines separation stage. The step of grading the sand may remove material having a particle size of greater than 2 mm.

In one embodiment the process may include the further step of controlling the water content of the sand upstream of the attrition scrubber unit such that the sand entering the attrition scrubber unit has a water content of between 20% and 25%. The water content of the sand may be controlled by determining the water content of the sand and adding water to the sand to achieve the required water content. The water content of the sand may be determined by monitoring the torque demand of the attrition scrubber unit.

The sand may pass into a counter flow classification unit upstream of the second fines separation stage, wherein an upwards flow of water separates particles smaller than 200 μm from the sand, the sand product settling in the bottom of the counter flow classification unit, the sand being removed from the bottom of the counter flow classification unit before being passed into the further dewatering stage.

According to a further aspect of the present invention there is provided an apparatus for refining sand for use as frac sand including an elongate chassis, a first fines separating device being mounted on the chassis adjacent to and downstream of the grading screen for separating fine material from the sand, a first dewatering screen being mounted on the chassis adjacent to and downstream of the first fines separating device for receiving sand therefrom, an attrition scrubber unit being mounted on the chassis adjacent to and downstream of the first dewatering screen, the attrition scrubber unit receiving sand from the first dewatering screen, the attrition scrubber unit containing a plurality of moving blades adapted to delaminate clay and other contaminants from the sand grains as the sand passes through the attrition scrubber unit, a second fines separating device, a second dewatering screen being provided on a second end of the chassis, opposite the first end, for receiving the sand product from the second fines separating device to dewater the sand product.

Optionally, the first fines separating device includes a first hydro-cyclone unit.

Optionally, the second fines separating device includes a second hydro-cyclone unit.

The first and/or the second hydro-cyclone units may include multiple cyclones having a common inlet manifold, and common outlet manifolds.

The second fines separating device may further include a classifier unit being mounted on the chassis for receiving sand from the second hydro-cyclone unit for further separating fine contaminants from the sand Optionally, the classifier unit is mounted on the chassis beneath the second hydro-cyclone unit. The classifier unit may include a counter flow classification unit having at least one tank into which the sand is introduced downstream of the second hydro-cyclone unit, an upward flow of water being passed into a lower region of the at least one tank at a predetermined velocity to lift fine particles up into an overflow weir of the tank, the sand product settling and being collected in a lower region of the tank. In a preferred embodiment the classifier unit includes two or more counter flow classification units mounted side by side on the chassis.

The apparatus may further include a grading screen mounted on a first end of the chassis for removing oversize material from the sand upstream of the first fines separating device. A pump may be provided for pumping sand, entrained in a flow of water, from a sump of the grading screen into the first fines separating device.

A control device may be provided for controlling the water content of the sand upstream of the attrition scrubber unit such that the sand entering the attrition scrubber unit has a water content of between 20% and 25%. The control device may determine the water content of the sand downstream of the first dewatering screen and adds water to the sand to achieve the required water content. The control device may determine the water content of the sand by monitoring the torque applied the attrition scrubber unit.

The chassis may be separable into two or more elongate sections to allow the apparatus to be containerised for transportation to the site.

The components of the various stages of the apparatus may be mounted on and may be spread along the length of the chassis, minimising the distance the sand has to be moved between each stage.

Preferably the various components of the apparatus are located at substantially the same height along the length of the chassis.

These and other objects, advantages and features of the invention will become apparent upon review of the following specification in conjunction with the drawings.

BRIEF DESCRIPTION OF THE DRAWINGS

A frac sand refining apparatus and method will now be described, by way of example only, with reference to the accompanying drawings, in which.

DESCRIPTION OF THE PREFERRED EMBODIMENTS

Figure 1:
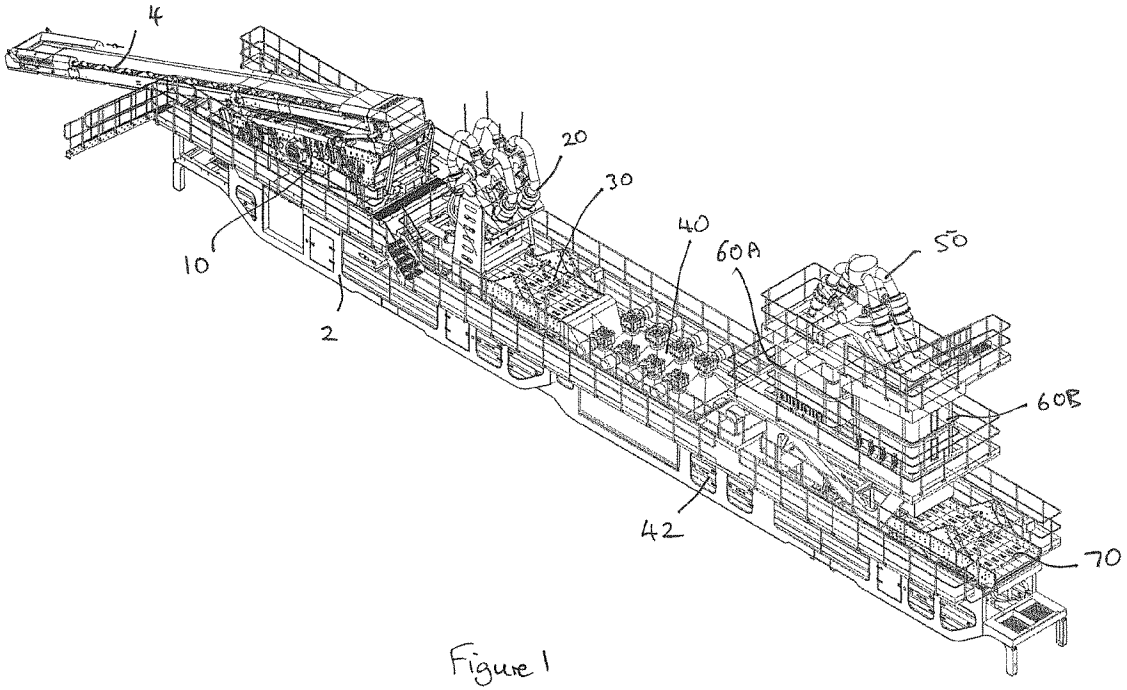
FIG. 1 is a perspective view of an apparatus for refining frac sand in accordance with an embodiment of the present invention.
Figure 2:
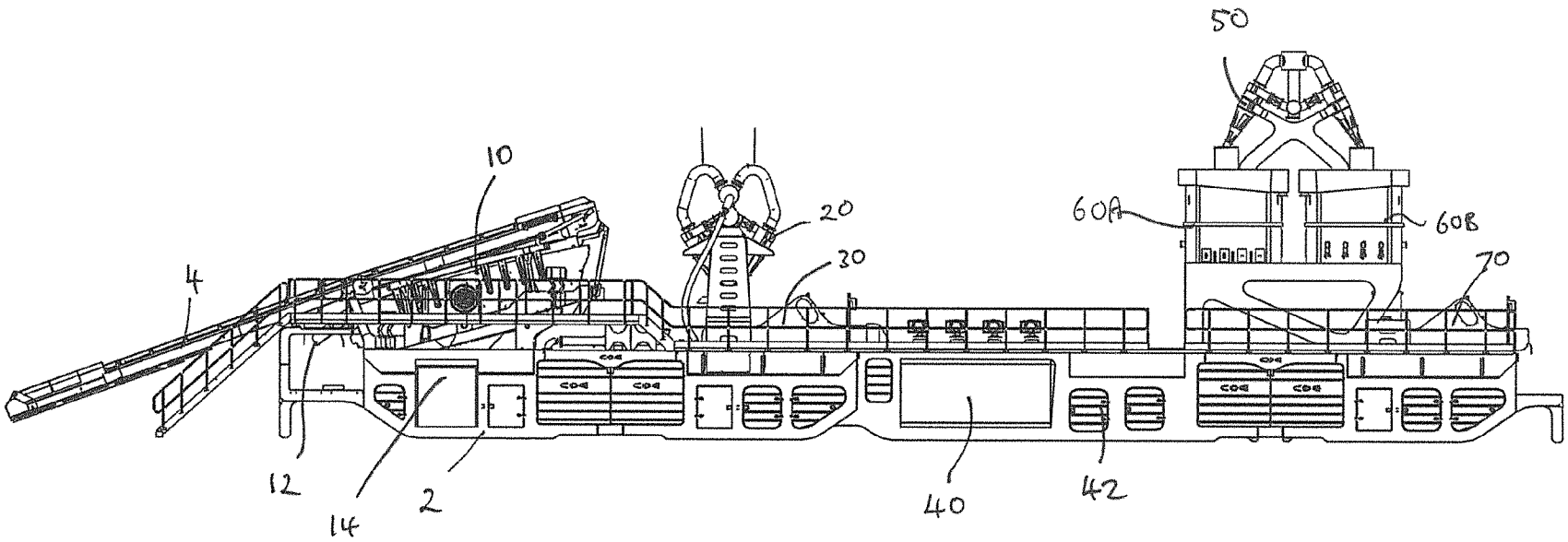
FIG. 2 is a side view of the apparatus of FIG. 1.
Figure 3:
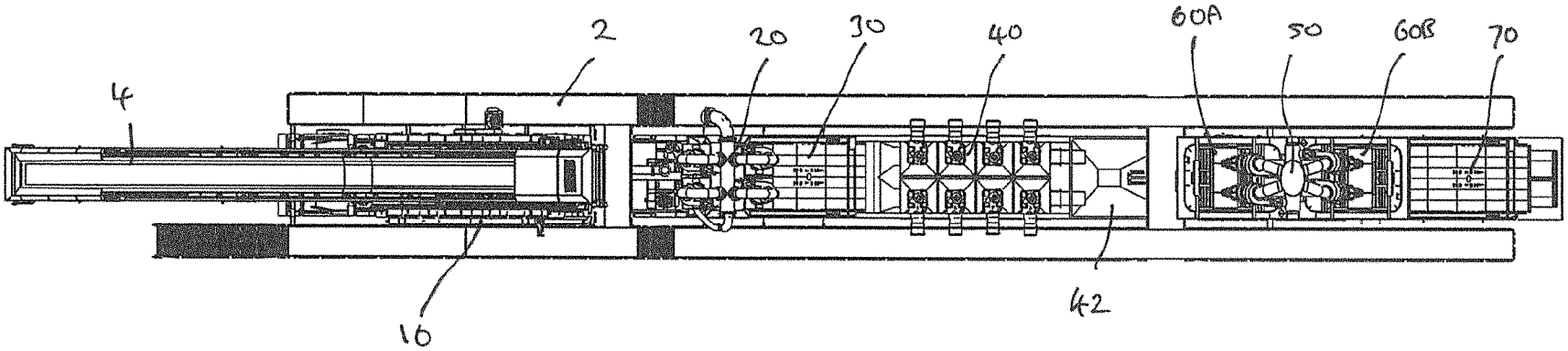
FIG. 3 is a plan view of the apparatus of FIG. 1.
Figure 4:
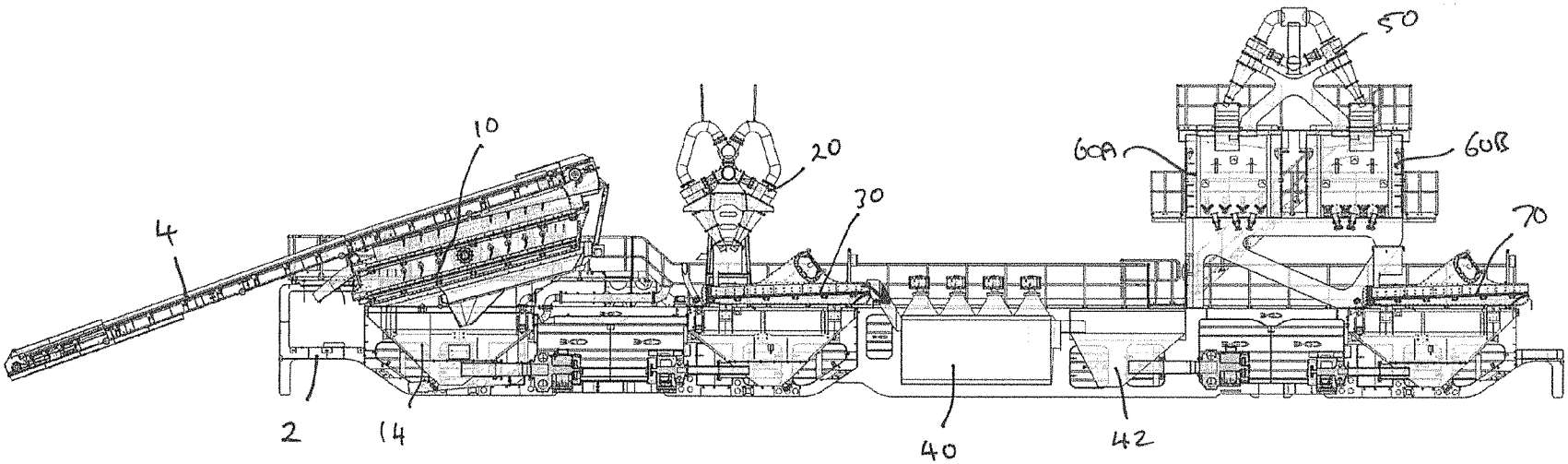
FIG. 4 is a longitudinal sectional view through the apparatus of FIG. 1.

As illustrated in the drawings, a frac sand refining apparatus in accordance with an embodiment of the present invention includes an elongate chassis 2 upon which the various stages of the refining apparatus are mounted. The chassis 2 may be separable into two or more sections to allow the apparatus to be containerised for transportation to the site. The components of the various stages of the apparatus are mounted on and are spread along the length of the chassis 2, minimising the distance the sand has to be moved between each stage. Furthermore, the various stages of the apparatus are located at substantially the same height along the length of the chassis 2, reducing pumping loads compared to prior art plants, where sand and water typically have to be pumped to considerable height as they are transferred between different stages of the refining operation.

In a first stage, material is loaded onto a lower end of an upwardly inclined feed conveyor 4 provided at a first end of the chassis 2, including a belt conveyor, and is delivered onto an inclined vibrating grading screen 10 located on the first end of the chassis 2 beneath the feed conveyor 4. The feed material is screened by the grading screen 10 into an oversize (waste product), passing off a lower end of the grading screen 10 to be delivered into a hopper or skip or onto a belt conveyor located beneath the feed conveyor 4 at the first end of the chassis 2. The undersize material (i.e. the sand product) passes through apertures in the deck of the grading screen 10 to be collected beneath the deck of the screen in a sump. Typically the cut point of this first stage may be approximately 2 mm (i.e. the screen deck having 2 mm apertures) to enable 250 tons per hour of material to pass through the 2 mm apertures of the screen deck, whereby the oversize material having a particle size greater than 2 mm is removed from the sand product. It is envisaged that decks having a smaller aperture size may be used where a smaller grain size if required. In one embodiment the screen deck may be 1.8 meters wide and 8 meters in length.

In a second stage, the product from the grading screen 10 is pumped from the sump of the grading screen 10, preferably using a centrifugal slurry pump and rubber lined pipework, to a first set of hydro-cyclones 20. The first set of hydro-cyclones 20 perform a separation process, typically removing very fine particles of sand and contaminants (e.g. clay & organics), as well as dewatering the product. The cut point of the second stage may be in the region of 63-75 μm. The hydro-cyclones 20 will also increase the concentration (i.e. reduce the water content) of the product by removing water as well as contaminants to facilitate the next stage of the process. Typical the underflow of the first set of the hydro-cyclones 20 is in the region of 1000 g/l. As shown in the drawings, the first set of hydro-cyclones 20 may include four cyclone arranged in adjacent pairs, fed from a common manifold and delivering an underflow and overflow to respective common outlet manifolds.

The third stage of the process is a dewatering stage, wherein the product from the first set of hydro-cyclones 20 is delivered onto a first vibratory dewatering screen 30 mounted on the frame 2 adjacent the first set of hydro-cyclones 20. The first set of hydro-cyclones 20 are mounted above a feed end of the first dewatering screen 30 such that the underflow of the hydro-cyclones 20 may be delivered onto the dewatering screen 30 by gravity.

A linear reciprocating force is applied to the first dewatering screen 30, via a pair of counter rotating eccentric masses as is known in the art, at a desired stroke and at a set frequency. This reciprocating motion of the screen 30 effectively shakes the excess water from the product, through small holes in the deck of the screen, reducing the moisture content of the product down to about 15%.

In a fourth stage, the product (sand) from the first dewatering screen 30 is then discharged from a discharge end of the screen and is subsequently gravity fed (or alternatively pumped) into an attrition cell cluster 40 mounted on the frame 2 adjacent and downstream of the first dewatering screen 30. The attrition cell cluster 40 includes a plurality of attrition scrubber cells (up to eight) arranged in series, each containing rotating blades which force sand grains against each other, resulting in intense scrubbing, polishing and disintegration of the sand, delaminating clay, graphite and other contaminants from the sand grains.

Figure 5:
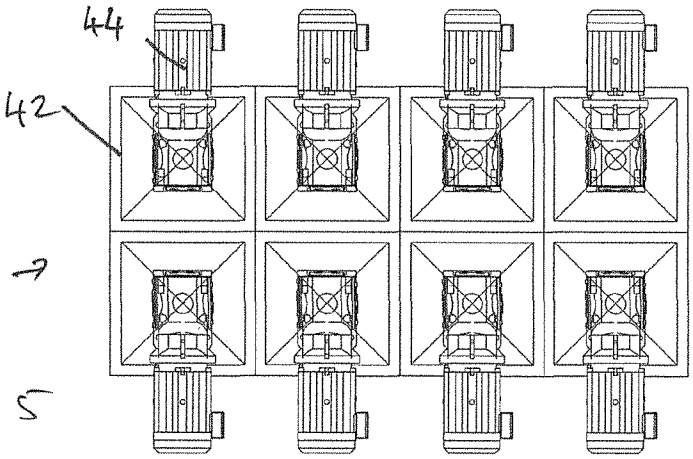
FIG. 5 is a detailed plan view of the attrition cell cluster of the apparatus of FIG. 1.
Figure 6:
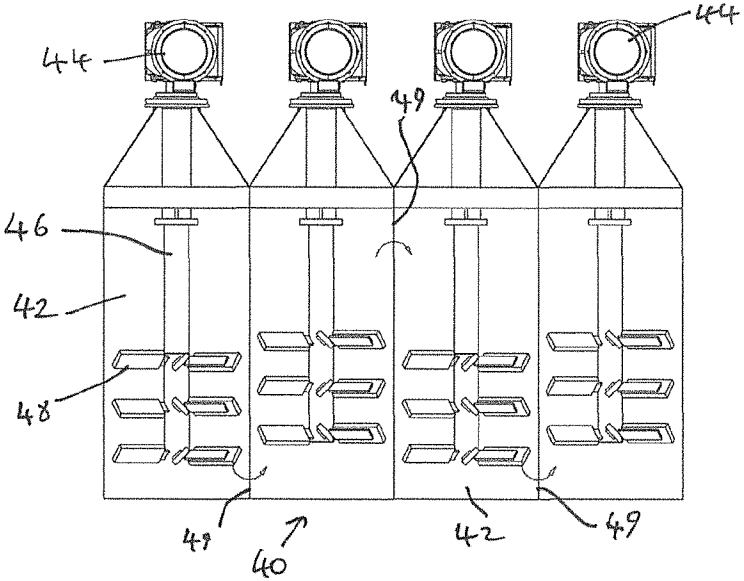
FIG. 6 is a longitudinal sectional view through one bank of cells of the attrition cell cluster of FIG. 5.

FIGS. 5 and 6 illustrate the attrition cell cluster 40 in more detail. As can be seen from FIG. 5, the attrition cell cluster includes eight cells 42 arranged in two banks of four, each cell 42 having a drive motor 44 mounted at an upper end and containing a vertically extending drive shaft 46 having a plurality of blades or vanes 48 mounted thereon. The drive motors 44 rotate the drive shafts 46 and thus move the blades 48 through the sand slurry contained within each cell 42. Openings 49 are provided between the cells 42 in each bank at alternating between upper and lower ends of the adjacent cells so that sand must pass through all of the cells 42 of each bank of cells in series, preferably passing vertically though each cell between the openings 49.

The water content of the product entering the attrition cell cluster 40 is carefully controlled to obtain a water content of 20% to 25% (adding water to the product to achieve the desired water content) to ensure optimum operation of the attrition cell cluster. This may be achieved by monitoring the torque load applied to the blades 48 by the drive motor 44 of the upstream most cell 42 of the attrition cell cluster 40 and adding water as necessary to achieve the optimum water content, resulting in maximum attrition of the sand. The attrition cell cluster 40 will remove all surface contamination off the sand grains. The water content may be controlled by means of a PLC (programmable logic controller), monitoring the torque of the motor 44 and controlling a motorised or pneumatically operated valve to add water into the cell 42 as required.

The product discharged from the attrition cell cluster 40 is fed into a sump or tank 42 mounted in the frame adjacent and downstream of the attrition cell cluster 40. Fresh water is added to the sand in the sump 42 to achieve the correct concentration for a subsequent pumping process (typically 350 g/l). A centrifugal slurry pump may be then used to feed the product into a second set of hydro-cyclones 50.

The second set of hydro-cyclones 50 perform another separation process in a fifth stage of the refining process, removing the very fine material (clay and other contaminants) separated from the sand grains in the attrition process. As shown in the drawings, the second set of hydro-cyclones 50 may also include an arrangement of four cyclones arranged in pairs, fed from a common manifold and delivering material to common outlet manifolds above and below the cyclones.

In a sixth stage, the underflow of the second set of hydro-cyclones 50 is fed into two (or more) counter flow classification units (CFCUs) 60A,60B upon which the second set of hydro-cyclones 50 are mounted. As shown in the drawings, each pair of hydro-cyclones 50 of the second set of hydro-cyclones 50 may feed a separate CFCU, the CFCUs 60A,60B being mounted side by side on the chassis 2 to maximise classification of the product without increasing the width of the apparatus. The CFCUs 60A,60B may separate particles smaller than 100 um or 200 um from the product, the cut point possibly varying from customer to customer to suit customer requirements.

In each CFCU 60A,60B the product is passed into a tank, wherein an upward flow of water is pumped into a lower region of the tank at a predetermined velocity (typically 8-10 mm/s) to lift finer particles up into an overflow weir of the tank. Larger particles will 20 want to settle in the tank, sinking to the bottom of the tank.

Using pressure transducers, the 'teeter bed' inside the tank of each CFCU can be determined, then, using this signal, a PLC can control the operation of an outlet valve, such as a modulating outlet pinch valve, at the bottom of each tank to maintain the level of this teeter bed. Using these controls a consistent level of separation can be performed. The overflow from each CFCU tank, including water contaminated with clay and other fine materials separated from the sand product, may be piped to a further process, such as a further cyclone separator and or dewatering screen, to allow the water to be recycled.

The underflow (product) of the tank of each CFCU is transferred to a seventh stage, including a further dewatering screen 70, for removing excess water from the sand product, which may then be discharged onto a stockpile conveyor.

The invention is not limited to the embodiment(s) described herein but can be amended or modified without departing from the scope of the present invention. Therefore, it will be appreciated that changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A process for refining sand for use as frac sand, the method comprising the steps of:

passing the sand through a first fines separation stage to remove fine particles of contaminant from the sand;

reducing the water content of the sand to less than 20%;

passing the sand into an attrition scrubber unit containing moving blades to delaminate clay and other contaminants from the sand;

passing the sand from the attrition scrubber unit through a second fines separation stage to separate fine contaminants from the sand;

dewatering the resulting sand product in a further dewatering stage; and controlling the water content of the sand upstream of the attrition scrubber unit such that the sand entering the attrition scrubber unit has a water content of between 20% and 25%;

wherein the water content of the sand is controlled by determining the water content of the sand and adding water to the sand to achieve the required water content, and wherein the water content of the sand is determined by monitoring the torque demand of the attrition scrubber unit.

2. The process of claim 1, wherein at least one of the first and second fines separating stages are carried out in a respective hydro-cyclone unit, and wherein the hydro-cyclone unit comprises multiple cyclones arranged in parallel to one another.

3. The process of claim 1, wherein the water content of the sand downstream of the first fines separation stage is reduced by a first dewatering screen.

4. The process of claim 1, wherein the further dewatering stage is carried out on a second dewatering screen.

5. The process of claim 1, comprising a first step of grading the sand to remove oversize material from the sand on a vibratory screen having an apertured deck upstream of the first fines separation stage.

6. The process of claim 5, wherein the step of grading the sand removes material having a particle size of greater than 2 mm.

7. The process of claim 1, wherein the sand is passes into a counter flow classification unit upstream of the second fines separation stage, wherein an upwards flow of water separates particles smaller than 200 μm from the sand, the sand product settling in the bottom of the counter flow classification unit, the sand being removed from the bottom of the counter flow classification unit before being passed into the further dewatering stage.

8. An apparatus for refining sand for use as frac sand, said apparatus comprising:

an elongate chassis;

a first fines separating device mounted on the chassis for separating fine material from the sand;

a first dewatering screen mounted on the chassis adjacent to and downstream of the first fines separating device and configured to receive sand therefrom;

an attrition scrubber unit mounted on the chassis adjacent to and downstream of the first dewatering screen, the attrition scrubber unit configured to receive sand from the first dewatering screen, the attrition scrubber unit containing a plurality of moving blades adapted to delaminate clay and other contaminants from the sand as the sand passes through the attrition scrubber unit;

a second fines separating device;

a second dewatering screen provided on a second end of the chassis, opposite a first end thereof, for receiving the sand from the second fines separating device and operable to dewater the sand product; and a control device that is operable to control the water content of the sand upstream of the attrition scrubber unit such that the sand entering the attrition scrubber unit has a water content of between 20% and 25%;

wherein the control device is operable to determine the water content of the sand downstream of the first dewatering screen and add water to the sand as required to achieve the water content of between 20% and 25%, wherein the control device determines the water content of the sand by monitoring torque applied the attrition scrubber unit.

9. The apparatus of claim 8, wherein the first fines separating device comprises a first hydro-cyclone unit.

10. The apparatus of claim 9, wherein the second fines separating device comprises a second hydro-cyclone unit, and wherein at least one of the first and second hydro-cyclone units comprises multiple cyclones having a common inlet manifold and a common outlet manifold.

11. The apparatus of claim 10, wherein the second fines separating device further comprises a classifier unit mounted on the chassis for receiving sand from the second hydro-cyclone unit for further separating fine contaminants from the sand.

12. The apparatus of claim 11, wherein the classifier unit comprises a counter flow classification unit comprising at least one tank, wherein the at least one tank is configured to receive the sand downstream of the second hydro-cyclone unit, wherein the at least one tank is configured to receive an upward flow of water passed into a lower region of the at least one tank at a predetermined velocity to thereby lift fine particles up into an overflow weir of the tank, and wherein a lower region of the tank is configured to collect settled sand product.

13. The apparatus of claim 8, further comprising a grading screen mounted on a first end of the chassis, upstream of the first fines separating device.

14. The apparatus of claim 8, wherein the chassis is separable into two or more elongate sections to allow the apparatus to be containerized for transportation to the site.

15. The apparatus of claim 8, wherein the first and second dewatering screens, the first and second fines separating devices, and the attrition scrubber unit comprise respective stages mounted on and spread along the length of the chassis in an arrangement that minimizes the distance the sand is moved between each stage.

16. The apparatus of claim 8, wherein the first and second dewatering screens, the first and second fines separating devices, and the attrition scrubber unit are located at substantially the same height along the length of the chassis.

* * * * *